US009478157B2

(12) United States Patent
Wu et al.

(10) Patent No.: US 9,478,157 B2
(45) Date of Patent: Oct. 25, 2016

(54) AMBIENT LIGHT ADAPTIVE DISPLAYS

(71) Applicant: Apple Inc., Cupertino, CA (US)

(72) Inventors: Jiaying Wu, Santa Clara, CA (US); Lu Zhang, West Lafayette, IN (US); Cheng Chen, San Jose, CA (US); Gabriel Marcu, San Jose, CA (US); Chaohao Wang, Cupertino, CA (US); Ming Xu, Sunnyvale, CA (US); Ricardo Motta, Palo Alto, CA (US); Wei Chen, Palo Alto, CA (US); John Z. Zhong, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/673,685

(22) Filed: Mar. 30, 2015

(65) Prior Publication Data

US 2016/0140889 A1 May 19, 2016

Related U.S. Application Data

(60) Provisional application No. 62/080,934, filed on Nov. 17, 2014.

(51) Int. Cl.
*G09G 5/00* (2006.01)
*G09G 3/20* (2006.01)
(Continued)

(52) U.S. Cl.
CPC ..... *G09G 3/2003* (2013.01); *G09G 3/3413* (2013.01); *G09G 5/02* (2013.01);
(Continued)

(58) Field of Classification Search
CPC ..... G09G 3/2003; G09G 3/3406; G09G 3/3413; G09G 2300/0242; G09G 2300/0626; G09G 2300/0666; G09G 2360/144; G09G 2340/06; G09G 3/3607; G09G 5/02; G09G 2320/0626; G09G 2320/066; H05B 37/0218; H04N 9/67; H04N 9/73
See application file for complete search history.

(56) References Cited

U.S. PATENT DOCUMENTS 5,710,876 A * 1/1998 Peercy et al. ..... 345/426
5,726,672 A * 3/1998 Hernandez ..... G06F 3/04897 345/22
(Continued)

FOREIGN PATENT DOCUMENTS

CN 201796510 4/2011
CN 201893105 7/2011
(Continued)

OTHER PUBLICATIONS

Chen et al., U.S. Appl. No. 14/673,667, filed on Mar. 30, 2015.

*Primary Examiner* — Joe H Cheng
(74) *Attorney, Agent, or Firm* — Treyz Law Group, P.C.; Kendall P. Woodruff

(57) ABSTRACT

An electronic device may include a display having an array of display pixels and having display control circuitry that controls the operation of the display. The display control circuitry may adaptively adjust the display output based on ambient lighting conditions. For example, in cooler ambient lighting conditions such as those dominated by daylight, the display may display neutral colors using a relatively cool white. When the display is operated in warmer ambient lighting conditions such as those dominated by indoor light sources, the display may display neutral colors using a relatively warm white. Adapting to the ambient lighting conditions may ensure that the user does not perceive color shifts on the display as the user's vision chromatically adapts to different ambient lighting conditions. Adaptively adjusting images in this way can also have beneficial effects on the human circadian rhythm by displaying warmer colors in the evening.

21 Claims, 10 Drawing Sheets

(51) Int. Cl.
*G09G 5/02* (2006.01)
*G09G 3/34* (2006.01)

(52) U.S. Cl.
CPC ..... *G09G2320/0242* (2013.01); *G09G 2320/0261* (2013.01); *G09G 2320/0666* (2013.01); *G09G 2360/144* (2013.01); *G09G 2360/145* (2013.01)

(56) References Cited

U.S. PATENT DOCUMENTS 5,952,992 A * 9/1999 Helms ..... 345/102
6,459,436 B1 * 10/2002 Kumada ..... G09G 5/02 345/589
6,480,202 B1 * 11/2002 Deguchi et al. ..... 345/600
6,611,297 B1 * 8/2003 Akashi ..... H04N 21/4131 348/602
6,870,567 B2 * 3/2005 Funston ..... H04N 5/2351 345/590
6,947,017 B1 * 9/2005 Gettemy ..... 345/63
6,952,195 B2 * 10/2005 Arakawa ..... G09G 3/3406 345/102
7,142,218 B2 * 11/2006 Yoshida ..... G09G 3/3607 345/589
7,468,722 B2 * 12/2008 Ferguson ..... 345/102
7,969,478 B1 * 6/2011 Chen et al. ..... 348/223.1
7,973,779 B2 * 7/2011 Masalkar ..... 345/175
8,274,718 B2 * 9/2012 Kawai ..... 358/523
8,350,787 B2 * 1/2013 Tanba et al. ..... 345/77
8,520,022 B1 * 8/2013 Cohen et al. ..... 345/589
8,848,003 B2 * 9/2014 Takahashi et al. ..... 345/690
2001/0040588 A1 * 11/2001 Shiraiwa et al. ..... 345/690
2001/0050757 A1 12/2001 Yoshida et al.
2002/0080245 A1 6/2002 Parulski et al.
2002/0118294 A1 8/2002 Takano et al.
2002/0158812 A1 * 10/2002 Pallakoff ..... H04M 1/0214 345/5
2004/0070565 A1 * 4/2004 Nayar et al. ..... 345/156
2005/0280869 A1 * 12/2005 Kameyama ..... 358/3.01
2006/0007223 A1 * 1/2006 Parker ..... G01J 1/4204 345/207
2006/0109218 A1 * 5/2006 Kim et al. ..... 345/77
2007/0097333 A1 * 5/2007 Zavarehi et al. ..... 353/85
2007/0126727 A1 * 6/2007 Chiang ..... G09G 5/003 345/207
2008/0142687 A1 6/2008 Zhou et al.
2008/0180426 A1 * 7/2008 Liu et al. ..... 345/207
2008/0303918 A1 12/2008 Keithley
2009/0040205 A1 2/2009 Scheibe
2009/0096745 A1 4/2009 Sprague et al.
2009/0109129 A1 * 4/2009 Cheong et al. ..... 345/20
2009/0153888 A1 6/2009 Edge
2009/0167950 A1 * 7/2009 Chen ..... G06F 3/14 348/602
2009/0195670 A1 * 8/2009 Koishi ..... G06T 15/50 348/223.1
2009/0201309 A1 * 8/2009 Demos ..... G01J 3/02 345/589
2010/0060674 A1 * 3/2010 Yoshida et al. ..... 345/690
2010/0060911 A1 * 3/2010 Marcu et al. ..... 358/1.9
2010/0194289 A1 * 8/2010 Katayanagi et al. ..... 315/151
2010/0320919 A1 12/2010 Gough et al.
2011/0206348 A1 * 8/2011 Numakami ..... 386/248
2012/0019493 A1 * 1/2012 Barnhoefer et al. ..... 345/207
2012/0050307 A1 3/2012 Mahowald et al.
2012/0081279 A1 4/2012 Greenebaum et al.
2012/0081663 A1 * 4/2012 Schmid ..... A61B 3/11 351/205
2012/0182276 A1 7/2012 Kee
2012/0268437 A1 10/2012 Lee
2012/0287605 A1 * 11/2012 Chen et al. ..... 362/97.1
2013/0093783 A1 * 4/2013 Sullivan ..... G09G 5/06 345/601
2013/0328842 A1 12/2013 Barnhoefer et al.
2014/0002428 A1 1/2014 Letourneur et al.
2014/0028197 A1 * 1/2014 van de Ven ..... 315/150
2014/0055481 A1 2/2014 Gao
2014/0063039 A1 * 3/2014 Drzaic ..... G09G 5/02 345/589
2014/0071102 A1 3/2014 Pieper et al.
2014/0152703 A1 * 6/2014 Yang et al. ..... 345/690
2014/0285477 A1 9/2014 Cho et al.
2014/0307007 A1 10/2014 Cho et al.
2014/0368483 A1 12/2014 Zhang et al.
2015/0070402 A1 * 3/2015 Shah et al. ..... 345/690

FOREIGN PATENT DOCUMENTS

| | | |
|---|---|---|
| EP | 2172925 | 4/2010 |
| EP | 2299723 | 3/2011 |
| EP | 2557557 | 2/2013 |
| GB | 2341033 | 3/2000 |
| JP | 09186896 | 7/1997 |
| JP | H09098301 | 8/1997 |
| JP | 11212056 | 8/1999 |
| JP | 2002041017 | 2/2002 |
| JP | 2002262119 | 9/2002 |
| JP | 2002290979 | 10/2002 |
| JP | 2002320233 | 10/2002 |
| JP | 2002325260 | 11/2002 |
| JP | 2003150099 | 5/2003 |
| JP | 2004531716 | 10/2004 |
| JP | 2008205542 | 9/2008 |
| JP | 2008206067 | 9/2008 |
| JP | 2009244340 | 10/2009 |
| JP | 2009267967 | 11/2009 |
| JP | 2010-113301 | 5/2010 |
| JP | 2010217133 | 9/2010 |
| JP | 2010128218 | 10/2010 |
| JP | 2011205275 | 10/2011 |
| JP | 2012027104 | 2/2012 |
| KR | 1020070014813 | 2/2007 |
| KR | 20120119717 | 10/2012 |
| KR | 1020140094561 | 7/2014 |
| KR | 20140116607 | 10/2014 |
| TW | 200826038 | 6/2008 |
| WO | 2013058945 | 4/2013 |
| WO | 2014068830 | 5/2014 |
| WO | 2015038407 | 3/2015 |

* cited by examiner

AMBIENT LIGHT ADAPTIVE DISPLAYS

This application claims priority to U.S. provisional patent application No. 62/080,934, filed Nov. 17, 2014, which is hereby incorporated by reference herein in its entirety.

BACKGROUND

This relates generally to electronic devices with displays and, more particularly, to electronic devices with displays that adapt to different ambient lighting conditions.

The chromatic adaptation function of the human visual system allows humans to generally maintain constant perceived color under different ambient lighting conditions. For example, an object that appears red when illuminated by sunlight will also be perceived as red when illuminated by an indoor electric light.

Conventional displays do not typically account for different ambient lighting conditions or the chromatic adaptation of the human visual system. As a result, a user may perceive undesirable color shifts in the display under different ambient lighting conditions. For example, the white point of a display may appear white to a user in outdoor ambient lighting conditions, but may appear bluish to the user in an indoor environment when the user's eyes have adapted to the warmer light produced by indoor light sources.

It would therefore be desirable to be able to provide improved ways of displaying images with displays.

SUMMARY

An electronic device may include a display having an array of display pixels and having display control circuitry that controls the operation of the display. The display control circuitry may adaptively adjust the output from the display based on ambient lighting conditions.

An electronic device may include a display having an array of display pixels and having display control circuitry that controls the operation of the display. The display control circuitry may adaptively adjust the display output based on ambient lighting conditions. For example, in cooler ambient lighting conditions such as those dominated by daylight, the display may display neutral colors using a relatively cool white. When the display is operating in warmer ambient lighting conditions such as those dominated by indoor light sources, the display may display neutral colors using a relatively warm white.

The display control circuitry may adjust the output from the display by adjusting the neutral point of the display. The neutral point of a display may be defined as the color emitted by the display when displaying a neutral color such as white. The display control circuitry may adjust the neutral point of the display based on ambient light information gathered by a light sensor.

Adapting to the ambient lighting conditions may ensure that the user does not perceive color shifts on the display as the user's vision chromatically adapts to different ambient lighting conditions. Adaptively adjusting images in this way can also have beneficial effects on the human circadian rhythm by displaying warmer colors in the evening.

A user's visual system may chromatically adapt to the ambient light in the vicinity of the user (e.g., light emitted by the display, light emitted by other light sources such as the sun or a light bulb, etc.). Display control circuitry may determine an adapted neutral point based on an adaptation factor that indicates how heavily the display light should be weighted relative to ambient light from other light sources in determining what light the user is adapted to.

If desired, a user may be able to select and/or adjust the adaptation factor manually. For example, electronic device 10 may operate in different user-selectable modes such as a paper mode, a hybrid mode, and a normal mode. In the normal mode, the adaptation factor may be set to one such that the display's neutral point is maintained at a target white point. In the paper mode, the adaptation factor may be set to zero such that the display's neutral point adaptively adjusts to the ambient lighting conditions to maintain a paper-like appearance of images on the display. In the hybrid mode, the adaptation factor may be set to some value between zero and one such that the display's neutral point is dependent on both the display's white point and the ambient lighting conditions.

If desired, proximity sensor data may be used to determine the distance between the user and the display, which in turn can be used to determine the contribution of display light to the user's chromatic adaptation.

Further features of the invention, its nature and various advantages will be more apparent from the accompanying drawings and the following detailed description of the preferred embodiments.

DETAILED DESCRIPTION

Electronic devices such as cellular telephones, media players, computers, set-top boxes, wireless access points, and other electronic equipment may include displays. Displays may be used to present visual information and status data and/or may be used to gather user input data.

Figure 1:
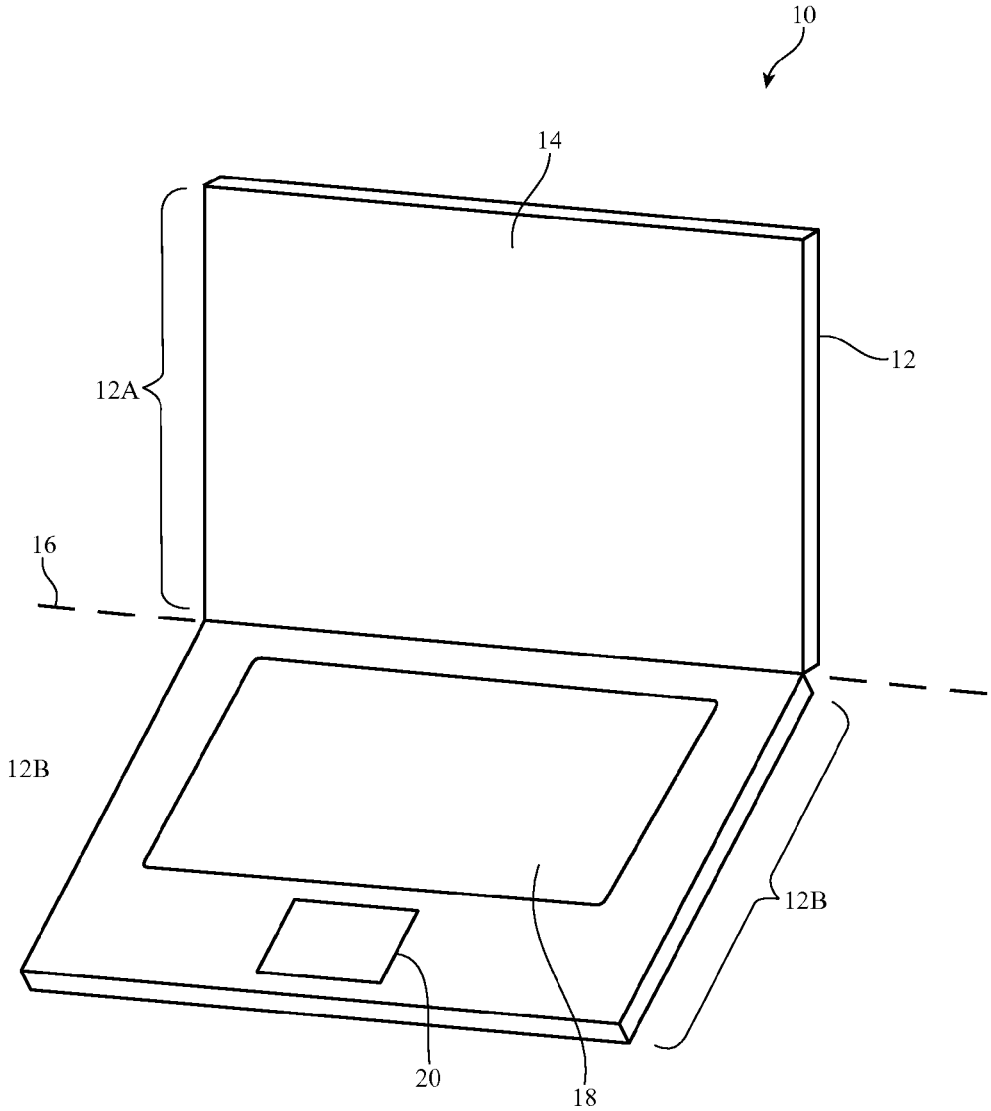
FIG. 1 is a perspective view of an illustrative electronic device such as a portable computer having an ambient light adaptive display in accordance with an embodiment of the present invention.

An illustrative electronic device of the type that may be provided with an ambient light adaptive display is shown in FIG. 1. Electronic device 10 may be a computer such as a computer that is integrated into a display such as a computer monitor, a laptop computer, a tablet computer, a somewhat smaller portable device such as a wrist-watch device, pendant device, or other wearable or miniature device, a cellular telephone, a media player, a tablet computer, a gaming device, a navigation device, a computer monitor, a television, or other electronic equipment.

As shown in FIG. 1, device 10 may include a display such as display 14. Display 14 may be a touch screen that incorporates capacitive touch electrodes or other touch sensor components or may be a display that is not touch-sensitive. Display 14 may include image pixels formed from light-emitting diodes (LEDs), organic light-emitting diodes (OLEDs), plasma cells, electrophoretic display elements, electrowetting display elements, liquid crystal display (LCD) components, or other suitable image pixel structures. Arrangements in which display 14 is formed using organic light-emitting diode pixels are sometimes described herein as an example. This is, however, merely illustrative. Any suitable type of display technology may be used in forming display 14 if desired.

Device 10 may have a housing such as housing 12. Housing 12, which may sometimes be referred to as a case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.).

As shown in FIG. 1, housing 12 may have multiple parts. For example, housing 12 may have upper portion 12A and lower portion 12B. Upper portion 12A may be coupled to lower portion 12B using a hinge that allows portion 12A to rotate about rotational axis 16 relative to portion 12B. A keyboard such as keyboard 18 and a touch pad such as touch pad 20 may be mounted in housing portion 12B.

Figure 2:
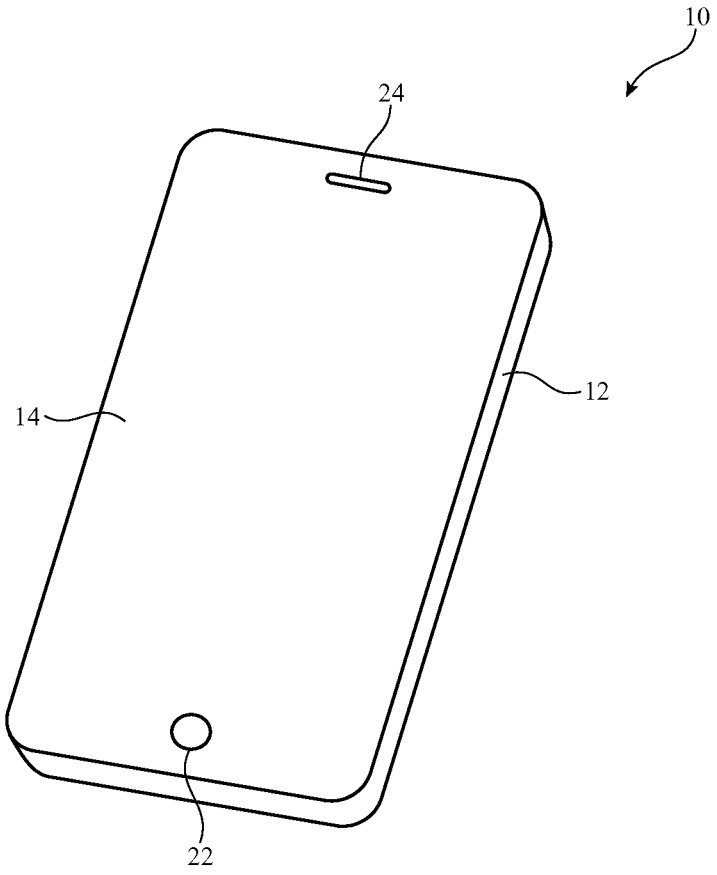
FIG. 2 is a perspective view of an illustrative electronic device such as a cellular telephone or other handheld device having an ambient light adaptive display in accordance with an embodiment of the present invention.

In the example of FIG. 2, device 10 has been implemented using a housing that is sufficiently small to fit within a user's hand (e.g., device 10 of FIG. 2 may be a handheld electronic device such as a cellular telephone). As show in FIG. 2, device 10 may include a display such as display 14 mounted on the front of housing 12. Display 14 may be substantially filled with active display pixels or may have an active portion and an inactive portion. Display 14 may have openings (e.g., openings in the inactive or active portions of display 14) such as an opening to accommodate button 22 and an opening to accommodate speaker port 24.

Figure 3:
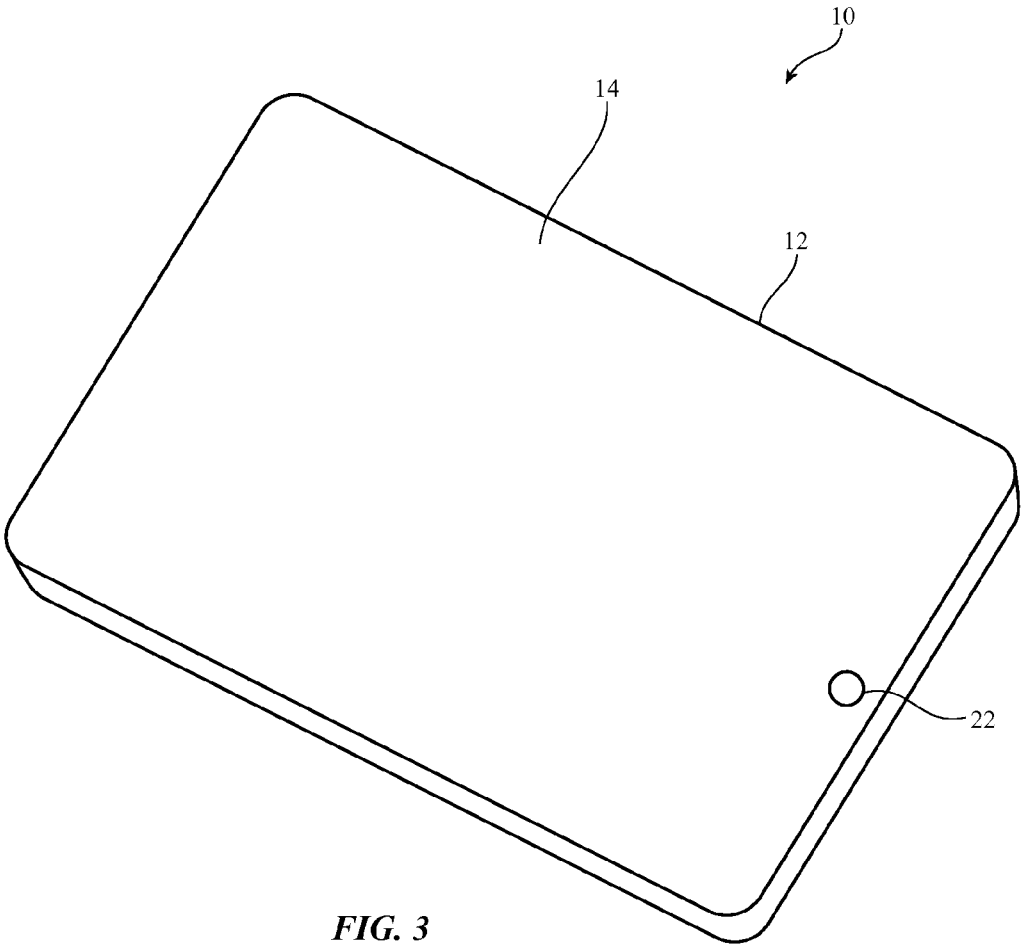
FIG. 3 is a perspective view of an illustrative electronic device such as a tablet computer having an ambient light adaptive display in accordance with an embodiment of the present invention.

FIG. 3 is a perspective view of electronic device 10 in a configuration in which electronic device 10 has been implemented in the form of a tablet computer. As shown in FIG. 3, display 14 may be mounted on the upper (front) surface of housing 12. An opening may be formed in display 14 to accommodate button 22.

Figure 4:
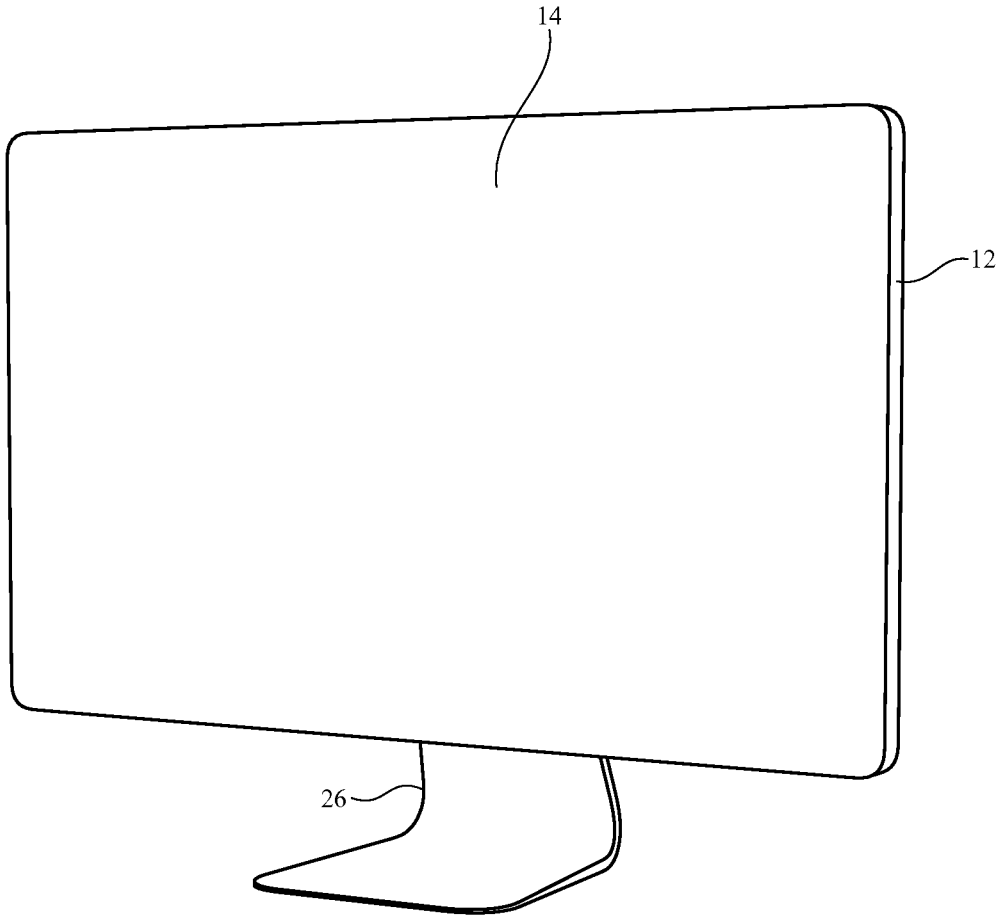
FIG. 4 is a perspective view of an illustrative electronic device such as a computer monitor with a built-in computer having an ambient light adaptive display in accordance with an embodiment of the present invention.

FIG. 4 is a perspective view of electronic device 10 in a configuration in which electronic device 10 has been implemented in the form of a computer integrated into a computer monitor. As shown in FIG. 4, display 14 may be mounted on a front surface of housing 12. Stand 26 may be used to support housing 12.

Figure 5:
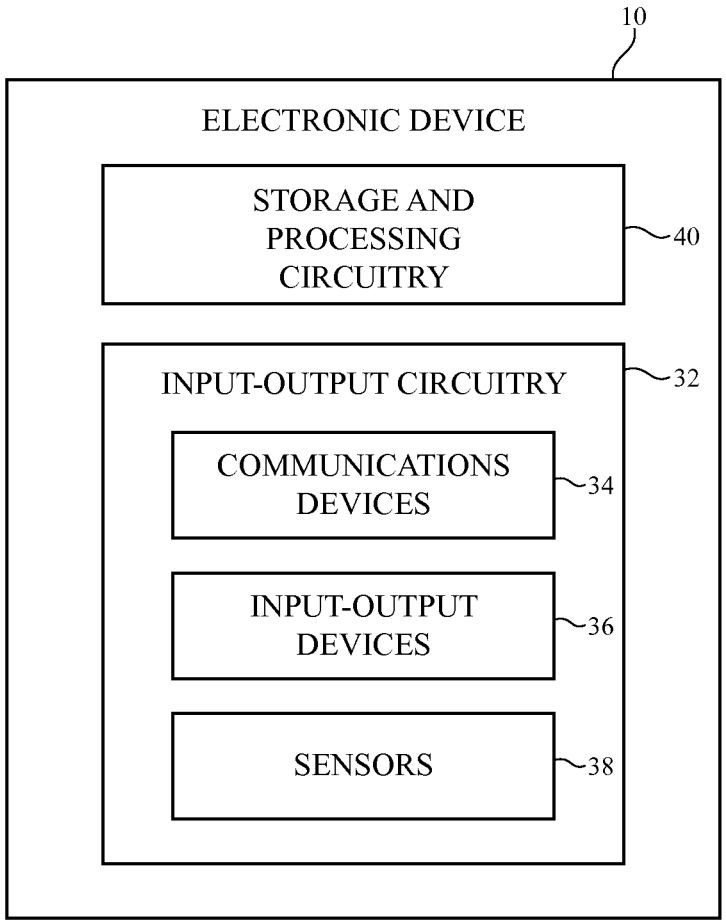
FIG. 5 is a schematic diagram of an illustrative system including an electronic device of the type that may be provided with an ambient light adaptive display in accordance with an embodiment of the present invention.

A schematic diagram of device 10 is shown in FIG. 5. As shown in FIG. 5, electronic device 10 may include control circuitry such as storage and processing circuitry 40. Storage and processing circuitry 40 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 40 may be used in controlling the operation of device 10. The processing circuitry may be based on one or more microprocessors, microcontrollers, digital signal processors, baseband processor integrated circuits, application specific integrated circuits, etc.

With one suitable arrangement, storage and processing circuitry 40 may be used to run software on device 10 such as internet browsing applications, email applications, media playback applications, operating system functions, software for capturing and processing images, software implementing functions associated with gathering and processing sensor data, software that makes adjustments to display brightness and touch sensor functionality, etc.

To support interactions with external equipment, storage and processing circuitry 40 may be used in implementing communications protocols. Communications protocols that may be implemented using storage and processing circuitry 40 include internet protocols, wireless local area network protocols (e.g., IEEE 802.11 protocols—sometimes referred to as WiFi®), protocols for other short-range wireless communications links such as the Bluetooth® protocol, etc.

Input-output circuitry 32 may be used to allow input to be supplied to device 10 from a user or external devices and to allow output to be provided from device 10 to the user or external devices.

Input-output circuitry 32 may include wired and wireless communications circuitry 34. Communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Input-output circuitry 32 may include input-output devices 36 such as button 22 of FIG. 2, joysticks, click wheels, scrolling wheels, a touch screen (e.g., display 14 of FIG. 1, 2, 3, or 4 may be a touch screen display), other touch sensors such as track pads or touch-sensor-based buttons, vibrators, audio components such as microphones and speakers, image capture devices such as a camera module having an image sensor and a corresponding lens system, keyboards, status-indicator lights, tone generators, key pads, and other equipment for gathering input from a user or other external source and/or generating output for a user or for external equipment.

Sensor circuitry such as sensors 38 of FIG. 5 may include an ambient light sensor for gathering information on ambient light, proximity sensor components (e.g., light-based proximity sensors and/or proximity sensors based on other structures), accelerometers, gyroscopes, magnetic sensors, and other sensor structures. Sensors 38 of FIG. 5 may, for example, include one or more microelectromechanical systems (MEMS) sensors (e.g., accelerometers, gyroscopes, microphones, force sensors, pressure sensors, capacitive sensors, or any other suitable type of sensor formed using a microelectromechanical systems device).

Figure 6:
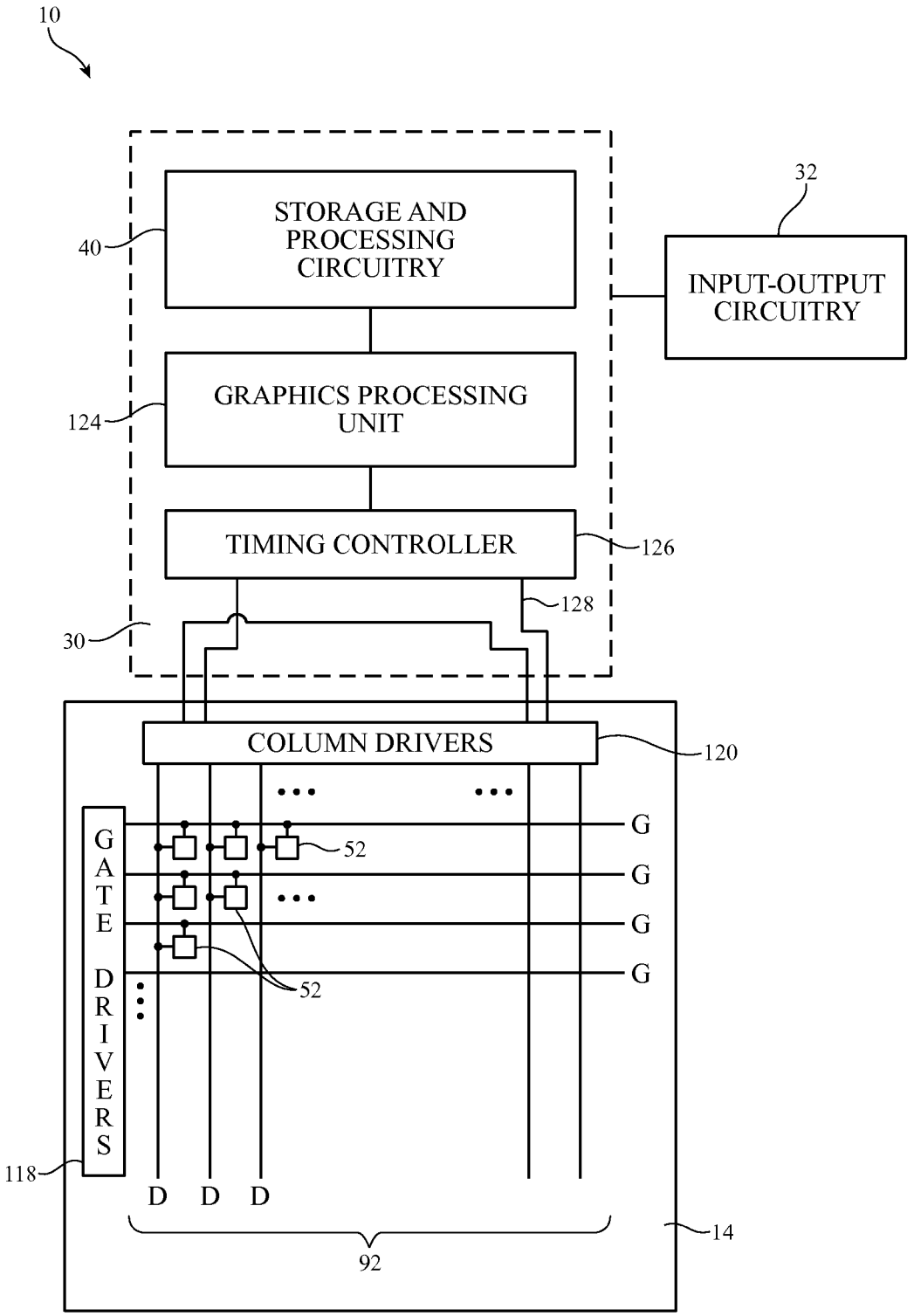
FIG. 6 is a schematic diagram of an illustrative electronic device having a display and display control circuitry in accordance with an embodiment of the present invention.

FIG. 6 is a diagram of device 10 showing illustrative circuitry that may be used in displaying images for a user of device 10 on pixel array 92 of display 14. As shown in FIG. 6, display 14 may have column driver circuitry 120 that drives data signals (analog voltages) onto the data lines D of array 92. Gate driver circuitry 118 drives gate line signals onto gate lines G of array 92. Using the data lines and gate lines, display pixels 52 may be configured to display images on display 14 for a user. Gate driver circuitry 118 may be implemented using thin-film transistor circuitry on a display substrate such as a glass or plastic display substrate or may be implemented using integrated circuits that are mounted on the display substrate or attached to the display substrate by a flexible printed circuit or other connecting layer. Column driver circuitry 120 may be implemented using one or more column driver integrated circuits that are mounted on the display substrate or using column driver circuits mounted on other substrates.

During operation of device 10, storage and processing circuitry 40 may produce data that is to be displayed on display 14. This display data may be provided to display control circuitry such as timing controller integrated circuit 126 using graphics processing unit 124.

Timing controller 126 may provide digital display data to column driver circuitry 120 using paths 128. Column driver circuitry 120 may receive the digital display data from timing controller 126. Using digital-to-analog converter circuitry within column driver circuitry 120, column driver circuitry 120 may provide corresponding analog output signals on the data lines D running along the columns of display pixels 52 of array 92.

Storage and processing circuitry 40, graphics processing unit 124, and timing controller 126 may sometimes collectively be referred to herein as display control circuitry 30. Display control circuitry 30 may be used in controlling the operation of display 14.

Each pixel 52 may, if desired, be a color pixel such as a red (R) pixel, a green (G) pixel, a blue (B) pixel, a white (W) pixel, or a pixel of another color. Color pixels may include color filter elements that transmit light of particular colors or color pixels may be formed from emissive elements that emit light of a given color.

Pixels 52 may include pixels of any suitable color. For example, pixels 52 may include a pattern of cyan, magenta, and yellow pixels, or may include any other suitable pattern of colors. Arrangements in which pixels 52 include a pattern of red, green, and blue pixels are sometimes described herein as an example.

Display control circuitry 30 and associated thin-film transistor circuitry associated with display 14 may be used to produce signals such as data signals and gate line signals for operating pixels 52 (e.g., turning pixels 52 on and off, adjusting the intensity of pixels 52, etc.). During operation, display control circuitry 30 may control the values of the data signals and gate signals to control the light intensity associated with each of the display pixels and to thereby display images on display 14.

Display control circuitry 30 may obtain red, green, and blue pixel values (sometimes referred to as RGB values or digital display control values) corresponding to the color to be displayed by a given pixel. The RGB values may be converted into analog display signals for controlling the brightness of each pixel. The RGB values (e.g., integers with values ranging from 0 to 255) may correspond to the desired pixel intensity of each pixel. For example, a digital display control value of 0 may result in an "off" pixel, whereas a digital display control value of 255 may result in a pixel operating at a maximum available power.

It should be appreciated that these are examples in which each color channel has eight bits dedicated to it. Alternative embodiments may employ greater or fewer bits per color channel. For example, each color may, if desired, have six bits dedicated to it. With this type of configuration, RGB values may be a set of integers ranging from 0 to 64. Arrangements in which each color channel has eight bits dedicated to it are sometimes described herein as an example.

As shown in FIG. 6, display control circuitry 30 may gather information from input-output circuitry 32 to adaptively determine how to adjust display light based on ambient lighting conditions. For example, display control circuitry 30 may gather light information from one or more light sensors (e.g., an ambient light sensor, a light meter, a color meter, a color temperature meter, and/or other light sensor), time information from a clock, calendar, and/or other time source, location information from location detection circuitry (e.g., Global Positioning System receiver circuitry, IEEE 802.11 transceiver circuitry, or other location detection circuitry), user input information from a user input device such as a touchscreen (e.g., touchscreen display 14) or keyboard, etc. Display control circuitry 30 may adjust the display light emitted from display 14 based on information from input-output circuitry 32.

Light sensors such as color light sensors and cameras may, if desired, be distributed at different locations on electronic device 10 to detect light from different directions. Other sensors such as an accelerometer and/or gyroscope may be used to determine how to weight the sensor data from the different light sensors. For example, if the gyroscope sensor data indicates that electronic device 10 is placed flat on a table with display 14 facing up, electronic device 10 may determine that light sensor data gathered by rear light sensors (e.g., on a back surface of electronic device 10) should not be used.

Display control circuitry 30 may be configured to adaptively adjust the output from display 14 based on ambient lighting conditions. In adjusting the output from display 14, display control circuitry 30 may take into account the chromatic adaptation function of the human visual system. This may include, for example, determining characteristics of the light that the user's eyes are exposed to.

Figure 7:
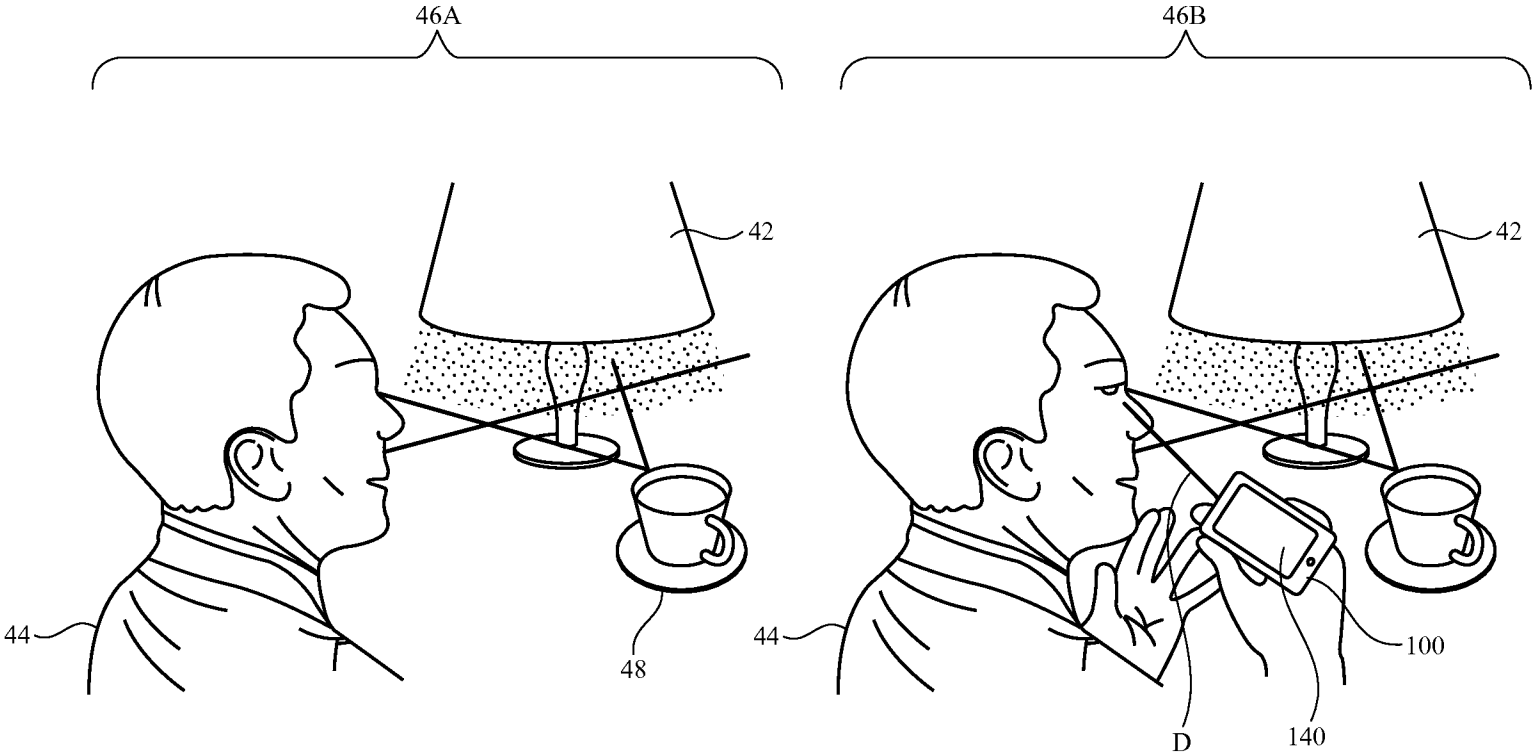
(PRIOR ART) FIG. 7
FIG. 7 is a diagram illustrating how a user may perceive undesirable color shifts when using a conventional display that does not account for the chromatic adaptation of the human visual system to different ambient lighting conditions.

FIG. 7 is a diagram illustrating the effects of using a conventional display that does not take into account the chromatic adaptation of human vision. In scenario 46A, user 44 observes external objects 48 under illuminant 42 (e.g., an indoor light source that generates warm light). The vision of user 44 adapts to the color and brightness of the ambient lighting conditions. Scenario 46B represents how a user perceives light from display 140 of device 100 after having adapted to the ambient lighting of illuminant 42. Because device 100 does not account for the chromatic adaptation of human vision, display 140 appears bluish and unsightly to user 44.

To avoid the perceived discoloration of display 14, display control circuitry 30 of FIG. 6 may adjust the output from display 14 based on ambient lighting conditions so that display 14 maintains a desired perceived appearance even as the user's vision adapts to different ambient lighting conditions.

The chromatic adaptation of a user's visual system may be determined by the light sources in the vicinity of the user. However, light sources such as light bulbs and the sun are not the only contributors to chromatic adaptation. Because display 14 is itself an illuminant, the light emitted from display 14 may also contribute to the chromatic adaptation of the user's vision. The amount by which a user's vision is adapted to the display light compared to the amount by which the user's vision is adapted to the surrounding ambient light (e.g., generated by light sources other than display 14) may depend on various factors. For example, as the distance between the user's eyes and the display decreases, the effect that the display light has on the user's chromatic adaptation increases relative to that of ambient light. As the brightness of the ambient light in the user's surroundings increases, the effect that the ambient light has on the user's chromatic adaptation increases relative to that of display light.

Display control circuitry 30 may use an "adaptation factor" $R_{adp}$ to determine how heavily the display light should be weighted relative to other ambient light sources when characterizing the light that the user is adapted to. When a user's vision is assumed to be completely adapted to display light without adapting to ambient light from surrounding light sources (e.g., when a user is viewing display 14 in a dark room), the adaptation factor may be equal to one. Conversely, when a user's vision is assumed to be completely adapted to the surrounding ambient light without adapting to the display light, the adaptation factor may be equal to zero.

Control circuitry 30 may use the adaption factor to determine how display light needs to be adjusted to accommodate the user's chromatic adaptation. The adaption factor may be determined based on user preferences, user input, proximity sensor data (e.g., proximity data indicating how far a user's eyes are from display 14), ambient light sensor data (e.g., ambient light sensor data indicating the brightness of ambient light in the vicinity of device 10), and/or other factors.

The adaptation factor may be determined on-the-fly (e.g., during operation of display 10) or may be determined during manufacturing (e.g., using subjective user studies) and stored in electronic device 10. If desired, a predetermined set of adaptation factors, each associated with a particular set of ambient light conditions and display conditions, may be stored in electronic device 10 and display control circuitry 30 may determine on-the-fly which adaption factor to use based on the current ambient lighting conditions and display conditions. This may include, for example, interpolating an adaption factor based on the predetermined adaptation factors stored in electronic device 10.

Control circuitry 30 may use the adaptation factor to determine an eye-adapted neutral point for display 14 and to adjust display light based on the eye-adapted neutral point. The neutral point of a display may refer to the target color to be produced by a pixel when the input RGB values for that pixel are equal (i.e., when R=B=G, where R, G, and B represent the digital display control values provided to a given pixel).

In a conventional display, the neutral point of the display is fixed and is typically referred to as the display's white point. Displays with a fixed neutral point may produce satisfactory colors in some scenarios but may produce unsatisfactory colors in other scenarios as the user's vision adapts to different ambient lighting conditions.

Figure 8:
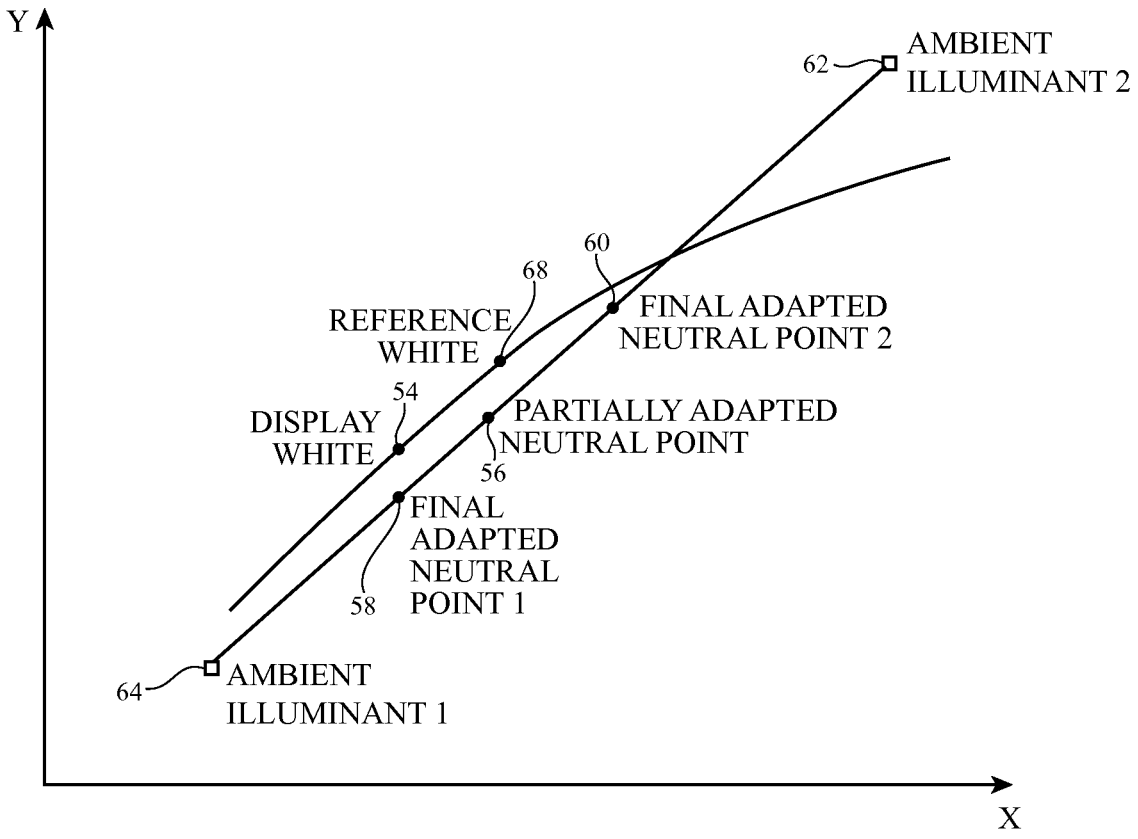
FIG. 8 is a chromaticity diagram showing how a display may have an adapted neutral point based on a current ambient lighting condition in accordance with an embodiment of the present invention.

A chromaticity diagram illustrating how display 14 may have an adaptive neutral point that is determined at least partly based on ambient lighting conditions is shown in FIG. 8. The chromaticity diagram of FIG. 8 illustrates a two-dimensional projection of a three-dimensional color space. The color generated by a display such as display 14 may be represented by chromaticity values x and y. The chromaticity values may be computed by transforming, for example, three color intensities (e.g., intensities of colored light emitted by a display) such as intensities of red, green, and blue light into three tristimulus values X, Y, and Z and normalizing the first two tristimulus values X and Y (e.g., by computing x=X/(X+Y+Z) and y=Y/(X+Y+Z) to obtain normalized x and y values). Transforming color intensities into tristimulus values may be performed using transformations defined by the International Commission on Illumination (CIE) or using any other suitable color transformation for computing tristimulus values.

Any color generated by a display may therefore be represented by a point (e.g., by chromaticity values x and y) on a chromaticity diagram such as the diagram shown in FIG. 8.

Display 14 may be characterized by color performance statistics such as a white point. The white point of a given display is commonly defined by a set of chromaticity values that represent the color produced by the display when the display is generating all available display colors at full power. Prior to any corrections during calibration, the white point of the display may be referred to as the "native white point" of that display. For example, point 54 of FIG. 8 may represent the native white point of display 14.

Due to manufacturing differences between displays, the native white point of a display may differ, prior to calibration of the display, from the desired (target) white point of the display. The target white point may be defined by a set of chromaticity values associated with a reference white (e.g., a white produced by a standard display, a white associated with a standard illuminant such as the D65 illuminant of the International Commission on Illumination (CIE), a white produced at the center of a display). In general, any suitable white point may be used as a target white point for a display. Point 68 of FIG. 8 may represent the target or reference white point for display 14.

In some scenarios, display control circuitry 30 may use reference white point 68 as the neutral point of display 14. In other scenarios, display control circuitry 30 may determine an eye-adapted neutral point that accounts for ambient lighting conditions and the chromatic adaptation of the human visual system. Determining the eye-adapted neutral point may include a first process in which display control circuitry 30 determines a partially adapted neutral point (e.g., point 56 of FIG. 8) and a second process in which display control circuitry 30 determines a final adapted neutral point (e.g., point 58 or point 60 of FIG. 8).

Partially adapted neutral point 56 may be determined based on the chromatic adaption of the user's visual system to the display light from display 14 (e.g., ignoring the effects of other light sources in the vicinity of the user). Because neutral point 56 compensates for the chromatic adaptation to display light but does not yet take into account the effects of other light sources, neutral point 56 is sometimes referred to a "partially adapted" neutral point.

After determining partially adapted neutral point 56, display control circuitry 30 may determine a final eye-adapted neutral point by taking into account the effects of mixed ambient light (e.g., light generated by display 14 and light generated by other light sources such as the sun, a lamp, etc.). For example, under a first ambient illuminant (represented by point 64 of FIG. 8), control circuitry 30 may determine a first eye-adapted neutral point (represented by point 58 of FIG. 8). Under a second ambient illuminant (represented by point 62 of FIG. 8), control circuitry 30 may determine a second eye-adapted neutral point (represented by point 60 of FIG. 8). The final eye-adapted neutral point may be determined based on the partially adapted neutral point 56, the adaptation factor $R_{adp}$, and the ambient light.

By adjusting the neutral point of display 14 based on the ambient lighting conditions, the colors that the user perceives will adapt to the different ambient lighting conditions just as the user's vision chromatically adapts to the different ambient lighting conditions. For example, illuminant 2 may correspond to an indoor light source, whereas illuminant 1 may correspond to daylight. Illuminant 2 may have a lower color temperature than illuminant 1 and may therefore emit warmer light. In warmer ambient light (e.g., under illuminant 2), display control circuitry 30 can adjust the neutral point of the display to adapted neutral point 60 to produce warmer light (i.e., light with a lower color temperature) than that which would be produced if the reference white point 68 were maintained as the target neutral point.

In addition to helping avoid perceived color shifts in different ambient lighting conditions, this type of adaptive image adjustment may also have beneficial effects on the human circadian rhythm. The human circadian system may respond differently to different wavelengths of light. For example, when a user is exposed to blue light having a peak wavelength within a particular range, the user's circadian system may be activated and melatonin production may be suppressed. On the other hand, when a user is exposed to light outside of this range of wavelengths or when blue light is suppressed (e.g., compared to red light), the user's melatonin production may be increased, signaling nighttime to the body.

Conventional displays do not take into account the spectral sensitivity of the human circadian rhythm. For example, some displays emit light having spectral characteristics that trigger the circadian system regardless of the time of day, which can in turn have an adverse effect on sleep quality.

In contrast, by using the image adjustment method described in connection with FIG. 8, the neutral point of display 14 may become warmer (e.g., may tend to the yellow portion of the spectrum) in warmer ambient lighting conditions. Thus, when a user is at home in the evening (e.g., reading in warm ambient light), blue light emitted from display 14 may be suppressed as the display adapts to the ambient lighting conditions. The reduction in blue light may in turn reduce suppression of the user's melatonin production (or, in some scenarios, may increase the user's melatonin production) to promote better sleep.

Figure 9:
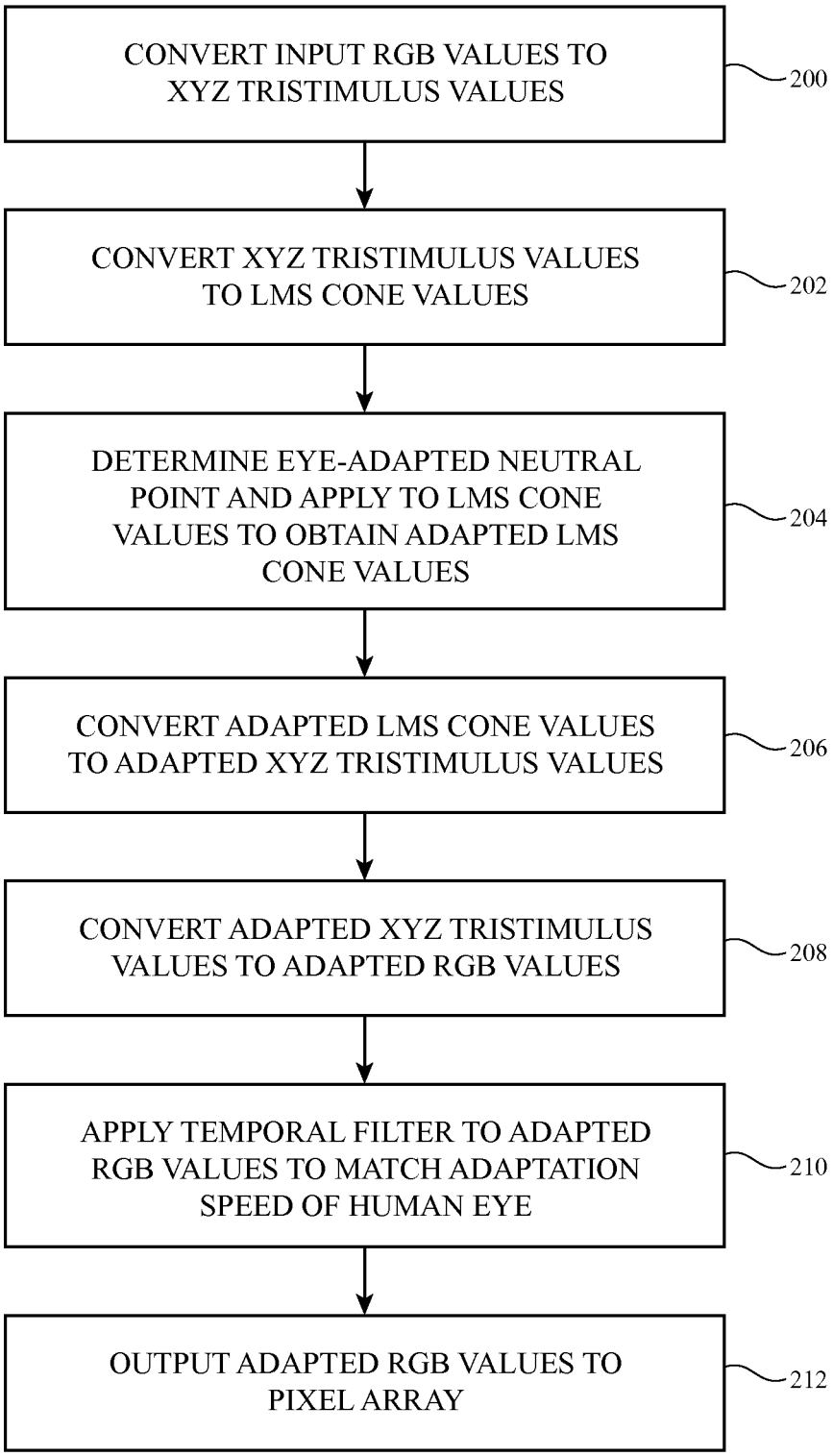
FIG. 9 is a flow chart of illustrative steps involved in displaying images that are compensated for ambient lighting conditions in accordance with an embodiment of the present invention.

FIG. 9 is a flow chart of illustrative steps involved in adjusting the output from display 14 based on ambient lighting conditions and based on the chromatic adaptation of the human visual system.

At step 200, display control circuitry 30 may convert incoming RGB digital display control values to XYZ tristimulus values using a known transformation matrix (e.g., a standard three-by-three conversion matrix).

At step 202, display control circuitry 30 may convert the XYZ tristimulus values to LMS cone values using a known transformation matrix (e.g., a standard three-by-three conversion matrix such as the Bradford conversion matrix, the chromatic adaptation matrix from the CIECAM02 color appearance model, or other suitable conversion matrix). The LMS color space is represented by the response of the three types of cones in the human eye. A first type of cone is sensitive to longer wavelengths of light, a second type of cone is sensitive to medium wavelengths of light, and a third type of cone is sensitive to shorter wavelengths of light. When the human visual system processes a color image, the image is registered by the long, medium, and short cone photoreceptors in the eye. The neural representation of the image can therefore be represented by three distinct image planes. By converting the incoming display data into the LMS color space, display control circuitry 30 can characterize and compensate for the effects of ambient light on each image plane separately. At step 204, display control circuitry 30 may determine an eye-adapted neutral point and may apply the eye-adapted neutral point to the LMS cone signals using the following equation:

$$\begin{bmatrix} C_L \cdot L \\ C_M \cdot M \\ C_S \cdot S \end{bmatrix} = \begin{bmatrix} L' \\ M' \\ S' \end{bmatrix} \tag{1}$$

where $C_L$, $C_M$, and $C_S$ represent the eye-adapted neutral point in the LMS color space; L, M, and S represent the input pixel values in the LMS color space; and L', M', and S' represent the adapted pixel values in the LMS color space. The eye-adapted neutral point is discussed in greater detail in connection with FIG. 10.

At step 206, display control circuitry 30 may convert the adapted LMS values L', M', and S' to adapted XYZ tristimulus values X', Y', and Z' using the standard matrix described in step 202 (e.g., the inverse of the conversion matrix used to convert XYZ tristimulus values to LMS cone values).

If desired, step 206 may optionally include a contrast compensation step in which the reflectance of ambient light is subtracted from the adapted XYZ tristimulus values using the following equation:

$$X_a = X' - R_x X_{(ambient)}$$

$$Y_a = Y' - R_y Y_{(ambient)}$$

$$Z_a = Z' - R_z Z_{(ambient)} \tag{2}$$

where X', Y', and Z' are the adapted XYZ tristimulus values prior to contrast compensation; $X_a$, $Y_a$, and $Z_a$ are the adapted XYZ tristimulus values compensated for contrast variation; $R_x$, $R_y$, and $R_z$ represent a reflectance factor (e.g., indicative of the amount of reflection of ambient light on the display); and $X_{(ambient)}$, $Y_{(ambient)}$, and $Z_{(ambient)}$ represent the tristimulus values associated with ambient light (e.g., as measured by a light sensor in electronic device 10).

At step 208, display control circuitry 30 may convert the adapted XYZ tristimulus values to adapted RGB values using the standard matrix described in step 200 (e.g., the inverse of the conversion matrix used to convert RGB pixel values to XYZ tristimulus values).

At optional step 210, display control circuitry 30 may apply a temporal filter to the adapted RGB values to ensure that the adjustment of images does not occur too quickly or too slowly relative to the speed at which the user adapts to different lighting conditions. Adjusting display images at controlled intervals in accordance with the timing of chromatic adaptation may ensure that the user does not perceive sharp changes in the display light as the ambient lighting conditions change.

At step 212, display control circuitry 30 may output the adapted RGB values to the pixel array (e.g., pixel array 92 of FIG. 6) of display 14 to thereby display images on display 14.

In some scenarios, the eye-adapted neutral point may deviate from the display's original white point. If care is not taken and the eye-adapted neutral point deviates significantly from the display white point, artifacts may arise such as color banding due to insufficient bits to represent a given color. To avoid such artifacts, display control circuitry 30 may impose constraints on the truncation level of RGB pixel values. For example, the minimum digital display control value that a red, green, or blue pixel value can be truncated to may be set to 240, 230, 220, or other suitable value.

The example described in connection with FIG. 9 where the output from display 14 is adjusted in the digital domain is merely illustrative. If desired, the output from display 14 may be adjusted in the analog domain by tuning the driving voltage for each color. This in turn allows for the bit depth of colors to be maintained.

If desired, other output sources in electronic device 10 may be adjusted to achieve the desired appearance of images on display 14. For example, other light sources in electronic device 10 (e.g., a light source associated with a camera flash or other suitable light source) may be turned on to achieve a desired effect on the chromatic adaptation of the user's visual system and/or to adjust the way that colors of display 14 appear to a user. In dark ambient lighting conditions, a light source associated with a camera flash may be used to illuminate the space around electronic device 10 and the user and thereby improve the perceived quality of images on display 14. The color and brightness of the supplemental light source may be adjusted based on sensor inputs and/or based on input from the user.

Figure 10:
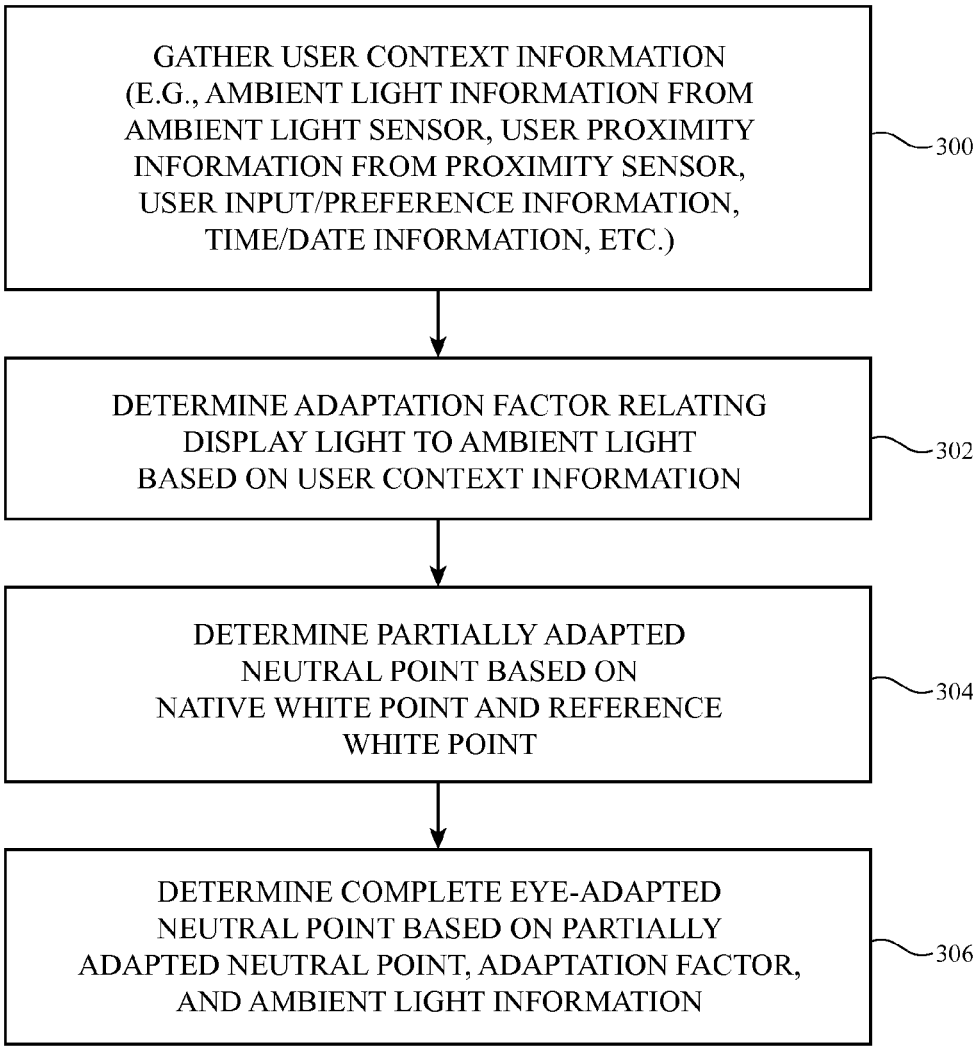
FIG. 10 is a flow chart of illustrative steps involved in determining an adaptive neutral point in accordance with an embodiment of the present invention.

FIG. 10 is a flow chart of illustrative steps involved in step 204 of FIG. 9 in which an eye-adapted neutral point for display 14 is determined based on ambient lighting conditions and the chromatic adaptation of the human visual system.

At step 300, display control circuitry 30 may gather user context information from various sources in device 10. For example, display control circuitry 30 may gather light information from one or more light sensors (e.g., an ambient light sensor, a light meter, a color meter, a color temperature meter, and/or other light sensor), proximity information from a proximity sensor, time, date, and/or season information from a clock or calendar application on device 10, location information from Global Positioning System receiver circuitry, IEEE 802.11 transceiver circuitry, or other location detection circuitry in device 10, user input information from a user input device such as a touchscreen (e.g., touchscreen display 14) or keyboard, user preference information stored in electronic device 10, and/or information from other sources in electronic device 10.

At step 302, display control circuitry 30 may determine an adaptation factor $R_{adp}$ based on the user context information. $R_{adp}$ may be a factor ranging from zero to one, where an adaptation factor of one presumes that the user is adapted completely to the display light without adapting to any other light sources (e.g., when display 14 is in a dark room). An adaptation factor of zero presumes that the user is adapted completely to the ambient light without adapting to the light emitted by display 14.

The adaptation factor may be determined on-the-fly (e.g., during operation of display 10) or may be determined during manufacturing (e.g., using subjective user studies) and stored in electronic device 10. For example, studies may indicate that the average user-preferred adaptation factor $R_{adp}$ is 0.6 when the distance between the user's eyes and the display is about 5 inches. If desired, a predetermined set of adaptation factors, each associated with a particular set of ambient light conditions and display conditions, may be stored in electronic device 10 and display control circuitry 30 may determine on-the-fly which adaption factor to use based on the currently ambient lighting conditions and display conditions. This may include, for example, interpolating an adaption factor based on the predetermined adaptation factors stored in electronic device 10.

If desired, a user may be able to select and/or adjust the adaptation factor manually. For example, electronic device 10 may operate in different user-selectable modes such as a paper mode, a hybrid mode, and a normal mode. In the normal mode, the adaptation factor may be set to one such that the display's neutral point is maintained at a target white point. In the paper mode, the adaptation factor may be set to zero such that the display's neutral point adaptively adjusts to the ambient lighting conditions. In the hybrid mode, the adaptation factor may be set to some value between zero and one (e.g., 0.6, 0.5, 0.4, etc.) such that the display's neutral point is dependent on both the display's white point and the ambient lighting conditions. The user-selectable modes may, for example, be presented as a sliding bar on the display such that the user can select any one of the three modes or any mode in between the three designated modes.

The adaptation factor may, for example, be based on proximity sensor data and light sensor data gathered in step 300. For example, proximity sensor data may be used to determine the distance between the user's eyes and display 14, which in turn can be used to determine the relative effect of display light on the user's chromatic adaptation. Light sensor data may be used to determine the brightness of the ambient light in the user's surroundings, which in turn can be used to determine the relative effect of ambient light on the user's chromatic adaptation.

At step 304, display control circuitry 30 may determine a partially adapted neutral point based on the native white point of the display and a reference white point. As described in connection with FIG. 8, this may include determining a partially adapted neutral point 56 based on display white point 54 and a reference white point 68. The following equation illustrates an example of how the partially adapted neutral point, $L'_n$, $M'_n$, $S'_n$, may be determined:

$$\begin{bmatrix} \overline{L'_n} \\ \overline{M'_n} \\ \overline{S'_n} \end{bmatrix} = \begin{bmatrix} \frac{1}{p_L} & 0 & 0 \\ 0 & \frac{1}{p_M} & 0 \\ 0 & 0 & \frac{1}{p_S} \end{bmatrix} \begin{bmatrix} \overline{L_n} \\ \overline{M_n} \\ \overline{S_n} \end{bmatrix} \tag{3}$$

where $L'_n$, $M'_n$, and $S'_n$ correspond to the LMS cone values associated with the partially adapted neutral point (point 56 of FIG. 8); $L_n$, $M_n$, and $S_n$ correspond to the LMS cone values associated with the display's white point (point 54 of FIG. 8); and $P_L$, $P_M$, and $P_S$ correspond to partial adaptation factors in LMS color space. $P_L$, $P_M$, and $P_S$ may be determined based on the reference white point for display 14 (e.g., point 68 of FIG. 8). The partially adapted neutral point determined in step 304 may be used to compensate for the chromatic adaptation of the user's visual system to display light. Because this compensation does not yet account for the chromatic adaptation to other light sources in the vicinity of the user, this step may sometimes be referred to as "incomplete" adaptation compensation.

At step 306, display control circuitry 30 may determine a final adapted neutral point based on the partially adapted neutral point determined in step 304, the adaptation factor determined in step 302, and ambient light information gathered in step 300. The following equations illustrate an example of how the final adapted neutral point, $L''_n$, $M''_n$, $S''_n$, may be determined:

$$\overline{L''_n} = R_{adp}\left(\frac{Y'_n}{Y_{adp}}\right)^{\frac{1}{3}}\overline{L'_n} + (1 - R_{adp})\left(\frac{Y_{n(Ambient)}}{Y_{adp}}\right)^{\frac{1}{3}}\overline{L_{n(Ambient)}} \tag{4}$$

$$\overline{M''_n} = R_{adp}\left(\frac{Y'_n}{Y_{adp}}\right)^{\frac{1}{3}}\overline{M'_n} + (1 - R_{adp})\left(\frac{Y_{n(Ambient)}}{Y_{adp}}\right)^{\frac{1}{3}}\overline{M_{n(Ambient)}}$$

$$\overline{S''_n} = R_{adp}\left(\frac{Y'_n}{Y_{adp}}\right)^{\frac{1}{3}}\overline{S'_n} + (1 - R_{adp})\left(\frac{Y_{n(Ambient)}}{Y_{adp}}\right)^{\frac{1}{3}}\overline{S_{n(Ambient)}}$$

$$Y_{adp} = \left(R_{adp}(Y'_n)^{\frac{1}{3}} + (1 - R_{adp})(\overline{Y_{n(Ambient)}})^{\frac{1}{3}}\right)^3$$

where $L''_n$, $M''_n$, $S''_n$ correspond to the LMS cone values associated with the final adapted neutral point (e.g., point 58 or 60 of FIG. 8); $L'_n$, $M'_n$, and $S'_n$ correspond to the LMS cone values associated with the partially adapted neutral point (point 56 of FIG. 8); $R_{adp}$ is the adaptation factor determined in step 302; $L_{n(Ambient)}$, $M_{n(Ambient)}$, $S_{n(Ambient)}$, and $Y_{n(Ambient)}$ correspond to the LMS cone values and brightness value associated with the measured ambient light (e.g., determined in step 300); and $Y'_n$ corresponds to the maximum brightness of display 14 adjusted for the reflection of ambient light on the display.

If desired, the final adapted neutral point may also be based at least partially on the time of day to achieve a desired effect on the user's circadian rhythm. For example, based on the time of day (or other information gathered during step 300), display control circuitry 30 may determine that the final adapted neutral point should tend towards the blue portion of the spectrum (e.g., during the day when the user's melatonin production should be suppressed) or that the final adapted neutral point should tend towards the yellow portion of the spectrum (e.g., during the evening when the user's melatonin levels should not be suppressed). The reduction in blue light during the evening may in turn reduce suppression of the user's melatonin production (or, in some scenarios, may increase the user's melatonin production) to promote better sleep.

The foregoing is merely illustrative of the principles of this invention and various modifications can be made by those skilled in the art without departing from the scope and spirit of the invention. The foregoing embodiments may be implemented individually or in any combination.

What is claimed is:

1. A method for displaying images on an array of display pixels in a display that emits display light, comprising:

with display control circuitry, gathering ambient light information from a light sensor;

determining an adaptation factor that weights a user's chromatic adaptation to the display light relative to the user's chromatic adaptation to ambient light based on the ambient light information;

determining a neutral color based on the adaptation factor; and adjusting input pixel values based on the neutral color to obtain adapted input pixel values.

2. The method defined in claim 1 wherein determining the adaptation factor comprises determining the adaptation factor based on the brightness of the display light.

3. The method defined in claim 1 wherein the adaptation factor is a value ranging from zero to one.

4. The method defined in claim 1 further comprising:

gathering proximity sensor data from a proximity sensor indicating a distance between the user and the display screen, wherein the adaptation factor is based on the distance.

5. The method defined in claim 1 wherein the ambient light information indicates a measured brightness level of the ambient light and wherein the adaptation factor is based on the measured brightness level.

6. The method defined in claim 1 wherein the display is operable in first and second user-selectable modes and wherein the adaptation factor is based on whether the display is operating in the first mode or the second mode.

7. The method defined in claim 1 further comprising:

determining a time of day, wherein determining the neutral color comprises determining the neutral color based on the time of day.

8. The method defined in claim 1 further comprising:

applying a temporal filter to the adapted input pixel values.

9. The method defined in claim 1 wherein the ambient light information indicates a color of the ambient light and wherein determining the neutral color comprises determining the neutral color based on the color of the ambient light.

10. The method defined in claim 1 wherein adjusting the input pixel values comprises adjusting the input pixel values in the LMS color space.

11. The method defined in claim 1 wherein determining the neutral color based on the adaptation factor comprises determining the neutral color to avoid perceivable color shifts.

12. An electronic device, comprising:

at least one light sensor that detects ambient light;

a display that emits display light and that is operable in at least first and second user-selectable modes, wherein colors displayed by the display in the first mode are determined based on the ambient light and wherein colors displayed by the display in the second mode are determined independently of the ambient light; and display control circuitry that adjusts input pixel values using an adaptation factor that weights a user's chromatic adaptation to the display light relative to the user's chromatic adaptation to the ambient light, wherein the adaptation factor is different for each of the user-selectable modes, and wherein the display control circuitry adjusts the input pixel values based on the ambient light when the display is operated in the first mode.

13. The electronic device defined in claim 12 wherein the display displays neutral colors having a first set of characteristics when operated in the first mode and displays neutral colors having a second set of characteristics when operated in the second mode, and wherein the first set of characteristics is different from the second set of characteristics.

14. The electronic device defined in claim 12 wherein the light sensor comprises a color light sensor that detects whether the ambient light is cool or warm.

15. The electronic device defined in claim 14 wherein display operating in the first mode displays neutral colors with warmer light when the ambient light is warm and displays the neutral colors with cooler light when the ambient light is cool.

16. The electronic device defined in claim 12 further comprising a gyroscope, wherein the at least one light sensor comprises a plurality of light sensors that gather ambient light sensor data, and wherein the display control circuitry uses the gyroscope to determine how to weight the ambient light sensor data from the plurality of light sensors.

17. A method for displaying images on an array of display pixels in a display that emits display light, comprising:

with display control circuitry, gathering ambient light information from a light sensor, wherein the ambient light information indicates whether ambient light is dominated by a first light source that emits light having a first color temperature or a second light source that emits light having a second color temperature, wherein the first color temperature is lower than the second color temperature;

with the display control circuitry, determining whether a user's chromatic adaptation is dominated by the display light or by the ambient light;

with the display control circuitry, operating the display to display neutral colors using a first color of light when the ambient light information indicates that the ambient light is dominated by the first light source and using a second color of light when the ambient light information indicates that the ambient light is dominated by the second light source, wherein the first color of light has a lower color temperature than the second color of light; and with the display control circuitry, operating the display to display neutral colors using a third color of light when the user's chromatic adaptation is dominated by the display light.

18. The method defined in claim 17 wherein the first light source is an indoor light source and wherein the second light source is daylight.

19. The method defined in claim 17 wherein the second color of light used to display neutral colors is based on a predetermined target white point.

20. The method defined in claim 19 wherein the first color of light used to display neutral colors is based on an adaptive neutral point that is determined on-the-fly using the ambient light information.

21. The method defined in claim 17 further comprising:

with a proximity sensor, detecting a proximity of the user to the display, wherein the first color of light used to display neutral colors is determined based on the proximity of the user to the display.

* * * * *